US005590802A

United States Patent [19]

Mitchell

[11] Patent Number: 5,590,802

[45] Date of Patent: Jan. 7, 1997

[54] SALVAGE DRUM WITH PROTECTED CLAMPING

[75] Inventor: Donald J. Mitchell, Wellsburg, W. Va.

[73] Assignee: Eagle Manufacturing Company, Wellsburg, W. Va.

[21] Appl. No.: 520,080

[22] Filed: Aug. 28, 1995

[51] Int. Cl.[6] ..... B65D 45/34; B65D 53/00

[52] U.S. Cl. ..... 220/321; 220/319; 220/378; 220/675

[58] Field of Search ..... 220/321, 214, 220/648, 658, 659, 671, 319, 378, 675; 215/274, 275, 384

[56] References Cited

U.S. PATENT DOCUMENTS

| | | | |
|---|---|---|---|
| Re. 28,521 | 8/1975 | Hammes | 215/274 X |
| 1,504,194 | 8/1924 | Treanor | 220/671 X |
| 1,712,274 | 5/1929 | Knowles | 215/274 |
| 2,727,673 | 12/1955 | Bergstrom | 229/14 |
| 3,696,962 | 10/1972 | Fehres et al. | 220/60 |
| 4,094,432 | 6/1978 | Zilbert | 220/404 |
| 4,177,934 | 12/1979 | Hammes et al. | 215/275 X |
| 4,648,522 | 3/1987 | Wise | 220/5 |
| 4,708,258 | 11/1987 | Shaw et al. | 220/288 |
| 4,709,833 | 12/1987 | Granberg et al. | 220/659 X |
| 5,096,083 | 3/1992 | Shaw et al. | 220/304 |
| 5,180,076 | 1/1993 | Hundt | 220/420 |
| 5,193,715 | 3/1993 | Schultz | 220/675 |
| 5,259,526 | 11/1993 | Stolzman | 220/355 |
| 5,358,133 | 10/1994 | Gillispie et al. | 220/304 |
| 5,373,958 | 12/1994 | Bokmiller | 220/284 |

FOREIGN PATENT DOCUMENTS

| | | | |
|---|---|---|---|
| 0364361 | 8/1906 | France | 215/274 |
| 092012062 | 7/1992 | WIPO | 220/321 |

*Primary Examiner*—Allan N. Shoap
*Assistant Examiner*—Niki M. Kopsidas
*Attorney, Agent, or Firm*—Armstrong, Westerman, Hattori, McLeland & Naughton

[57] ABSTRACT

A salvage drum has a container body and circular lid which are sealed together by a clamp that secures an outwardly extending lip on the container body to an outwardly extending lip on the circular lid. The container body has a plurality of spaced outwardly extending vertical ribs adjacent the body lip and the circular lid has an outwardly extending protective shoulder which is arranged such that the clamp is protected from impact with the ground regardless of tipping over or dropping of the salvage drum. The clamp is also easily stored on and held on the container body ready for use in sealing of the salvage drum.

15 Claims, 6 Drawing Sheets

SALVAGE DRUM WITH PROTECTED CLAMPING

FIELD OF THE INVENTION

The present invention relates to a salvage drum or overpack container primarily for the containment of an industrial drum to prevent dispersal of the drum contents should a leak occur in the drum.

BACKGROUND OF THE INVENTION

Salvage drums are used to ship and store industrial drums containing solvents and the like and are generally of a size such that the contents of the industrial drum will be retained in the salvage drum upon spillage or leakage. Various sealed salvage drums, and containers, which may be made of polyethylene, are shown, for example, in U.S. Pat. No. 4,708,258; U.S. Pat. No. 4,709,833; U.S. Pat. No. 5,096,083; U.S. Pat. No. 5,180,076; U.S. Pat. No. 5,358,133 which is assigned to the assignee of the present invention, and U.S. Pat. No. 5,373,958.

For use as a salvage drum, a container must conform to the strict requirements of the United States Department of Transportation, and pass tests such as drop tests and internal pressure tests, while maintaining a seal of the container, and stacking tests, which require a bottom sealed container to retain its seal when other sealed containers are stacked thereon. In one top corner drop test, a loaded, sealed container is dropped on an angle (about 70°) from a height onto the floor so that the upper corner of the container will impact with the floor and the salvage drum must remain sealed after such a drop. The corner drop test is a difficult test which must be passed in order to qualify for Department of Transportation clearance whether threaded lids are used or whether a clamp is used to secure a lid to a container body. Where a clamp is used, for example, impact of the clamp with the ground can cause damage to the clamp and result in leakage from a sealed salvage drum. An internal pressure test which must be passed in order to qualify a container as a salvage drum or overpack container requires that the lid retain a seal with the container body when an internal pressure of at least 3 pounds per square inch is present in the sealed container. In some containers where a seal is provided at the top of the container wall with a clamped lid, the lid will tend to deflect upon a buildup of internal pressure and bulges to an extent which causes a break in the seal between the container body and a lid.

It is an object of the present invention to provide a salvage drum having a lid secured to a container body by a clamp where the clamp is protected from direct impact with the ground upon tipping or dropping of the salvage drum so as to maintain the salvage drum in a sealed condition.

It is another object of the present invention to provide a salvage drum having a container body and lid sealed together by a band clamp which will retain a seal therebetween at an internal pressure of above three pounds per square inch.

It is a further object of the present invention to provide a salvage drum having a lid secured to a container body by a clamp where the clamp may be held on the container body before use in clamping the lid and container body together to prevent damage or loss of the clamp.

SUMMARY OF THE INVENTION

A salvage drum is provided which has a container body and a lid with a protected clamping device for sealing the lid on the body.

The container body has a bottom wall and an upwardly extending side wall, preferably tapering outwardly, which terminates as a radially outwardly extending lip and forms an open top for the container body. The side wall has a plurality of spaced outwardly extending vertical ribs which are spaced from and adjacent to the outwardly extending lip on the container body. A circular lid for placement over the open top of the container body has a radially outwardly extending lip about the periphery thereof adapted to mate with said body lip and an outwardly extending protective shoulder thereabout. The circular lid and container body are sealed together by means of a clamp which engages both the body lip on the container body and the lid lip on the circular lid and upon securement of the clamp seals the lips together.

The clamping device is preferably a V-shaped clamp and the lid lip and body lip are positioned in the groove of the V-shape. A sealing gasket is preferably provided between the body lip and lid lip prior to securement by the clamp. When the clamping device is not sealing the lid lip and body lip together, the same may be held on the container body by passing it downwardly over the body lip and resting the same on the vertical ribs on the body side wall. When the clamp is secured on the lips to seal the lid and body together, the clamp is situated radially inwardly from the outer surfaces of the vertical ribs on the container body and from the radially outermost surface of the protective shoulder on the circular top. Such positioning prevents direct contact of the clamp with the ground if the sealed container is dropped either on its side or on the lid from an upside down position and protects the clamp.

BRIEF DESCRIPTION OF THE DRAWINGS

The present invention will be more readily understood by reference to the drawings which illustrate a preferred embodiment of the salvage drum wherein.

DETAILED DESCRIPTION

The present invention provides a salvage drum for the storage and containment of materials where a clamp is used to seal a circular lid to a container body and the clamp is protected such that it will not impact with the ground regardless of how the salvage drum is dropped.

Figure 1:
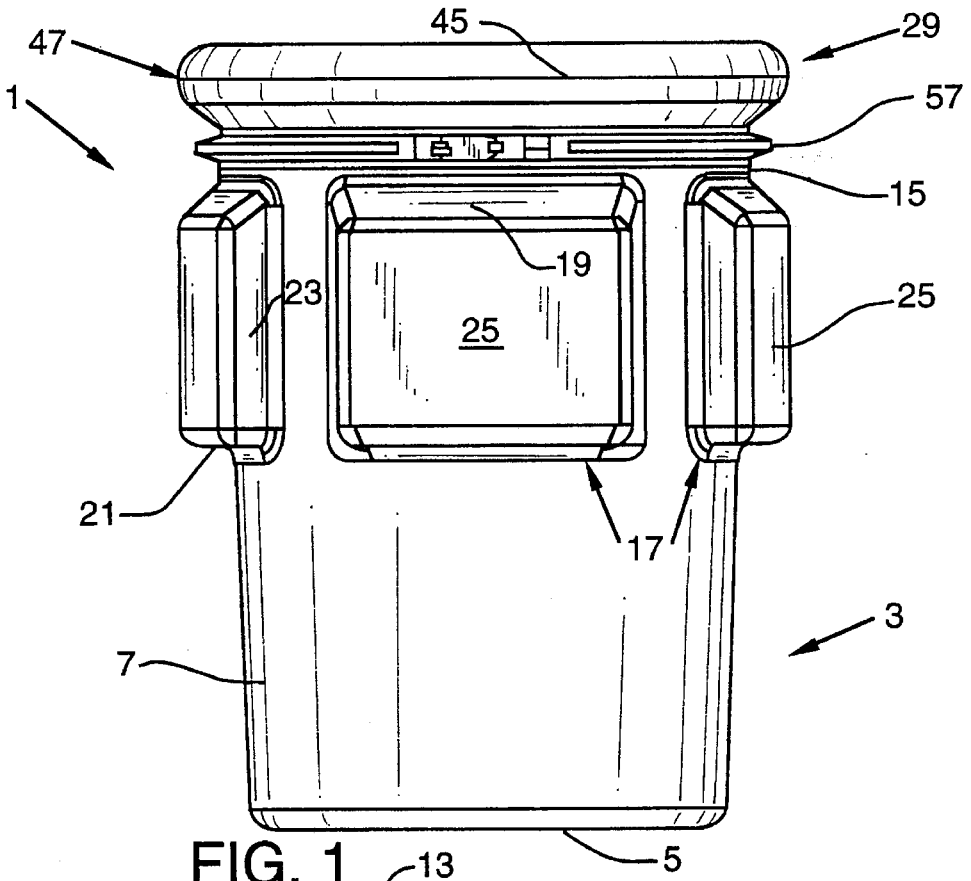
FIG. 1 is a side elevational view of the assembled salvage drum of the present invention showing the clamping device sealing the circular lid to the container body.
Figure 2:
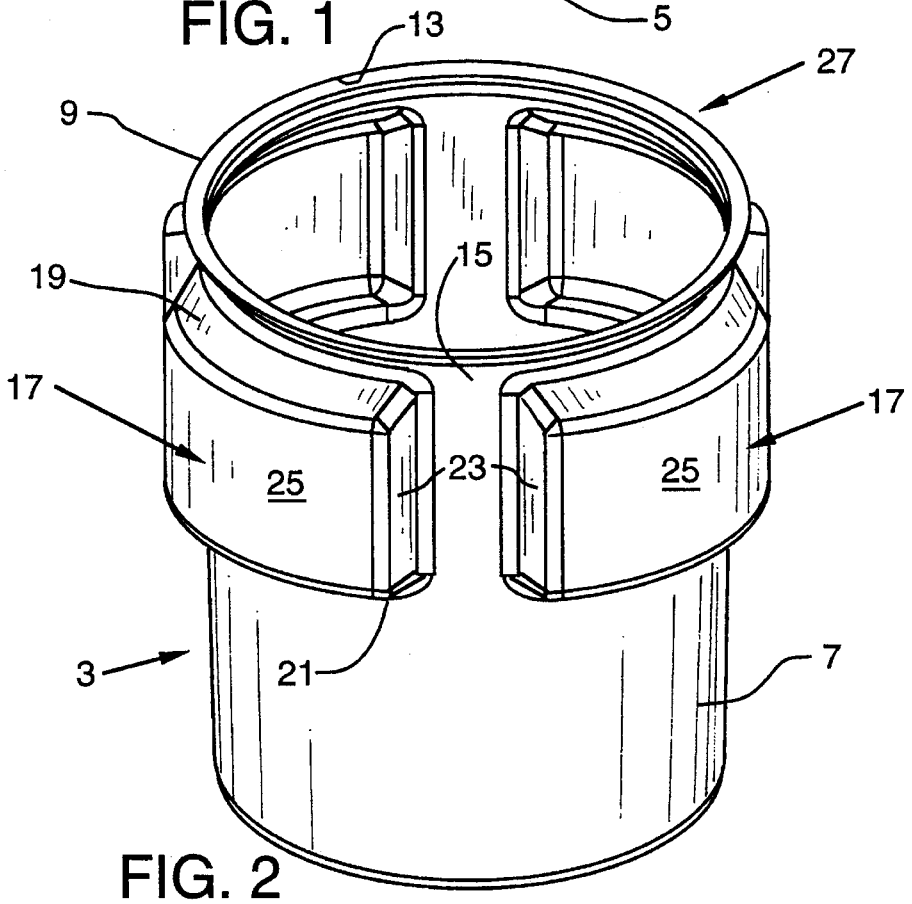
FIG. 2 is an isometric view of the body portion of the salvage drum of the present invention.
Figure 3:
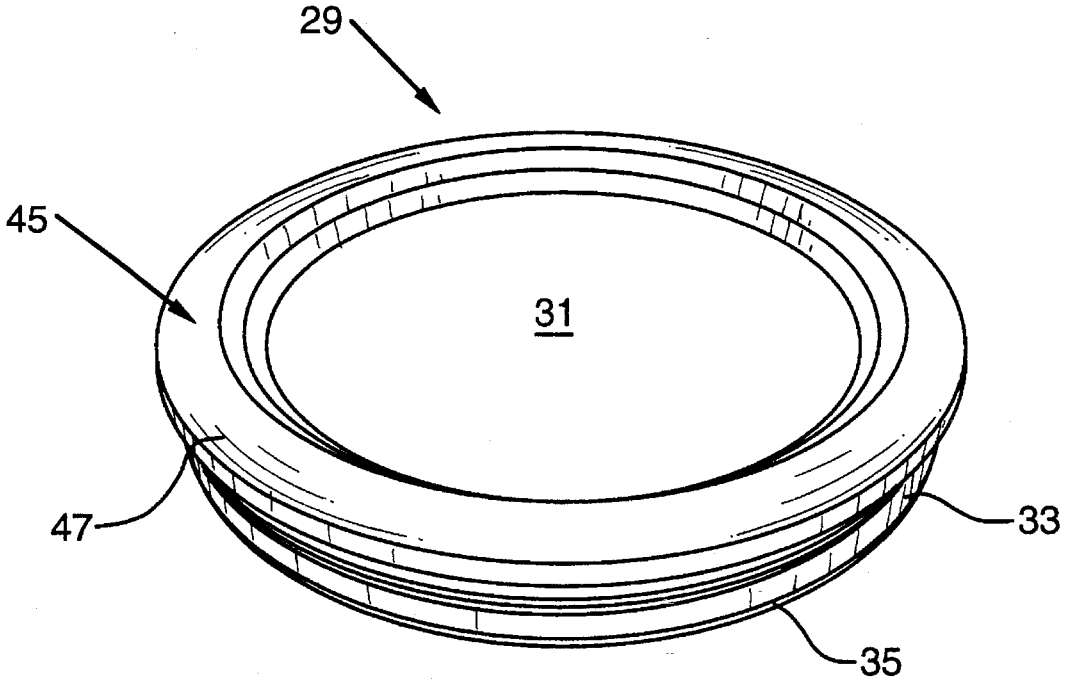
FIG. 3 is an isometric view of the circular lid of the salvage drum of the present invention.
Figure 4:
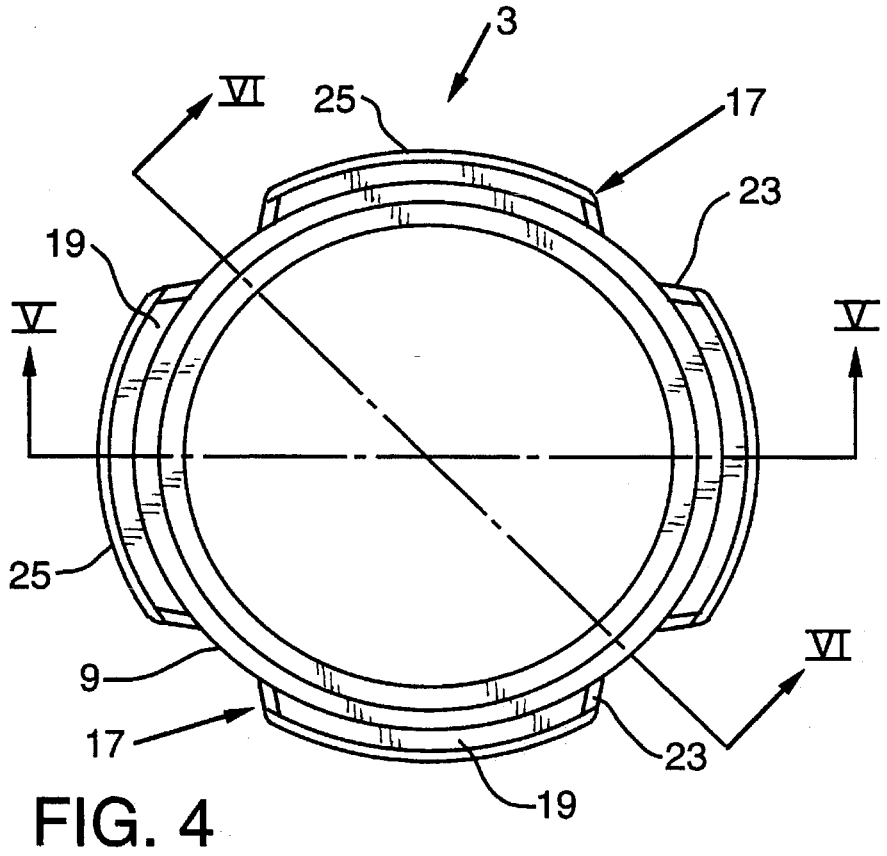
FIG. 4 is top plan view of the body portion of FIG. 2.
Figure 5:
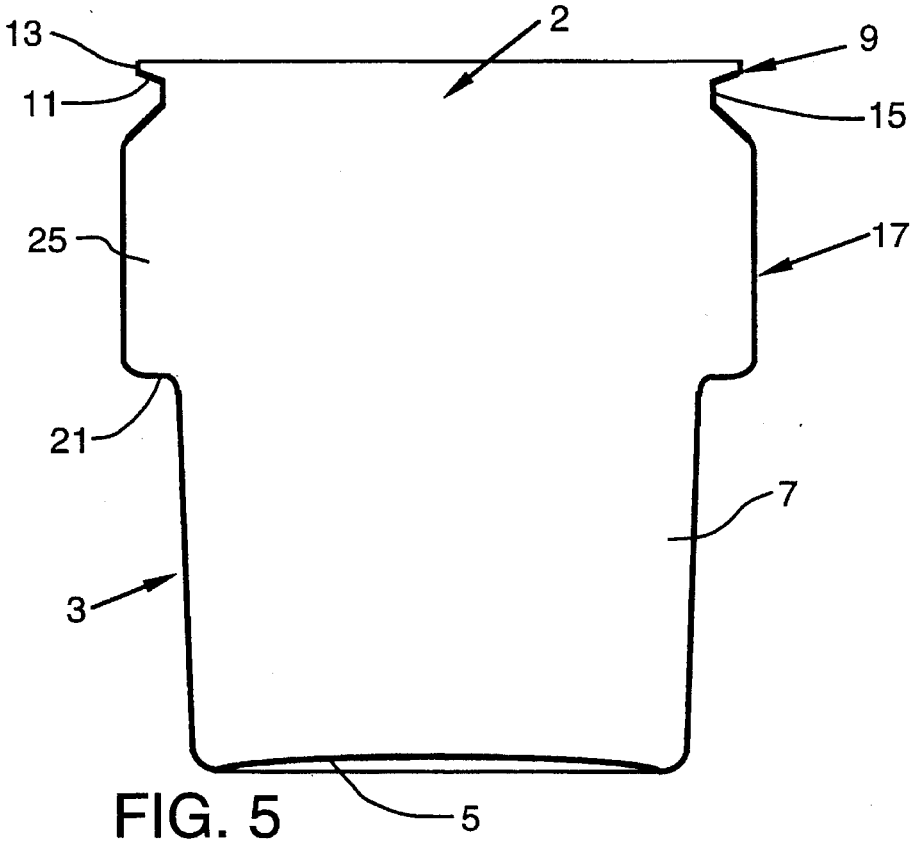
FIG. 5 is cross-sectional view of the body portion taken along lines V—V of FIG. 4.
Figure 6:
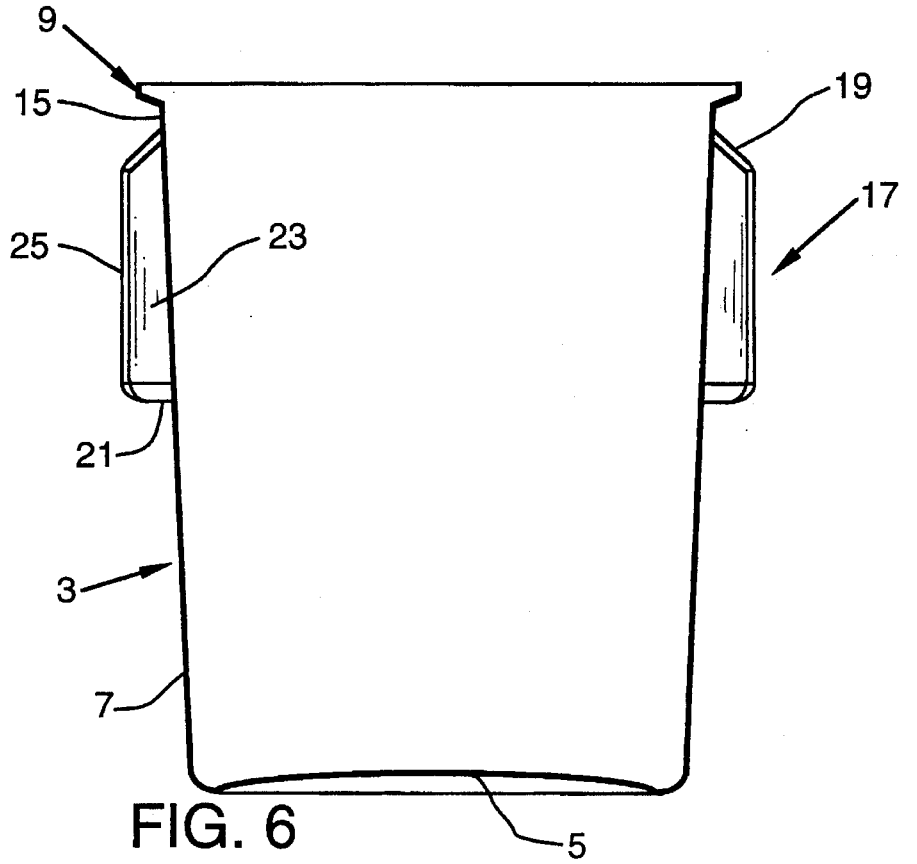
FIG. 6 is a cross-sectional view of the body portion taken along lines VI—VI of FIG. 4.

Referring now to the drawings, FIGS. 2, 4, 5 and 6 illustrate the container body 3 of the salvage drum 1 of the present invention, the sealed salvage drum 1 shown in FIG. 1. The container body 3 has a bottom wall 5 and an upwardly extending side wall 7 which terminates as a radially outwardly extending lip 9, the lip 9 preferably having an upwardly sloped lower surface 11 and a short upwardly extending retention flange 13 at the end thereof. The side wall 7 of the container body 3 is tapered outwardly from the bottom wall 5 towards the lip 9 so as to permit nesting of container bodies. Also, there is preferably provided on the side wall 7 a vertical, non-tapered section 15 adjacent the lip 9. The side wall 7 has a plurality of spaced outwardly extending vertical ribs 17 formed therein, each rib 17 preferably having an upper wall 19, lower wall 21, side walls 23 and outer wall 25. The number of outwardly extending vertical ribs 17 formed in the side wall (four shown) may vary provided that the number present is sufficient to provide protection for a clamping device as described later herein. The outwardly extending vertical ribs 17 are spaced from and adjacent to the radially outwardly extending lip 9 on the container body 3. The lip 9 of the container body forms a circular open top 27 for placement of a drum, such as a solvent drum, into the container body 3 of the salvage drum 1.

A circular lid 29 is provided for the salvage drum 1 which, as best illustrated in FIGS. 3 and 8–13, has a top wall 31 and a downwardly depending skirt 33 which has a radially outwardly extending lid lip 35 about the periphery thereof. The lid lip 35 preferably has a downwardly sloped upper surface 37 and a short downwardly extending retention flange 39 which, with the lower edge 41 of the downwardly depending skirt 33 forms a gasket receiving channel 43 in the lid lip 35. Also about the periphery of the circular lid 29 there is provided an outwardly extending protective shoulder 45, the shoulder preferably being a hollow shoulder with a radially outermost surface 47, which is preferably an arcuate surface. The outwardly extending protective shoulder may, if desired, be formed as a plurality of spaced outwardly extending shoulder portions, provided the protection of the clamp, as hereinafter described, is effected. The circular lid may have a series of hollow reinforcing ribs 49 on the underside 51 of the top wall 31, which ribs may comprise circular ribs 53 and radially extending ribs 55.

Figure 14:
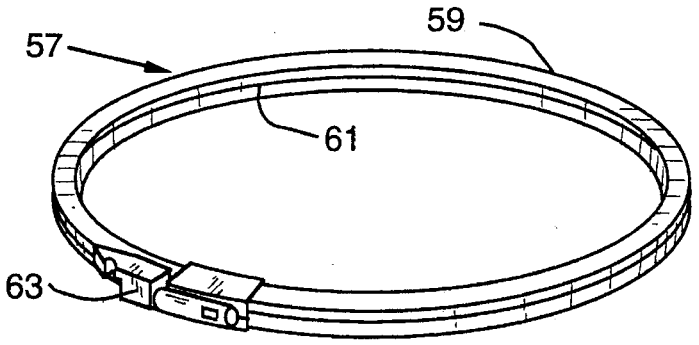
FIG. 14 is an isometric view of a clamping device preferably used on the salvage drum of the present invention.

The circular lid 29 is secured to the container body 3 by means of a clamping device, a preferred clamping device 57 being shown in FIG. 14. The preferred clamping device 57 is a clamp 59, which may be formed from metal, having a V-shape, with a groove 61 formed by the V-shape, and a locking means 63, the clamp 59 being a conventional type clamp.

Figure 7:
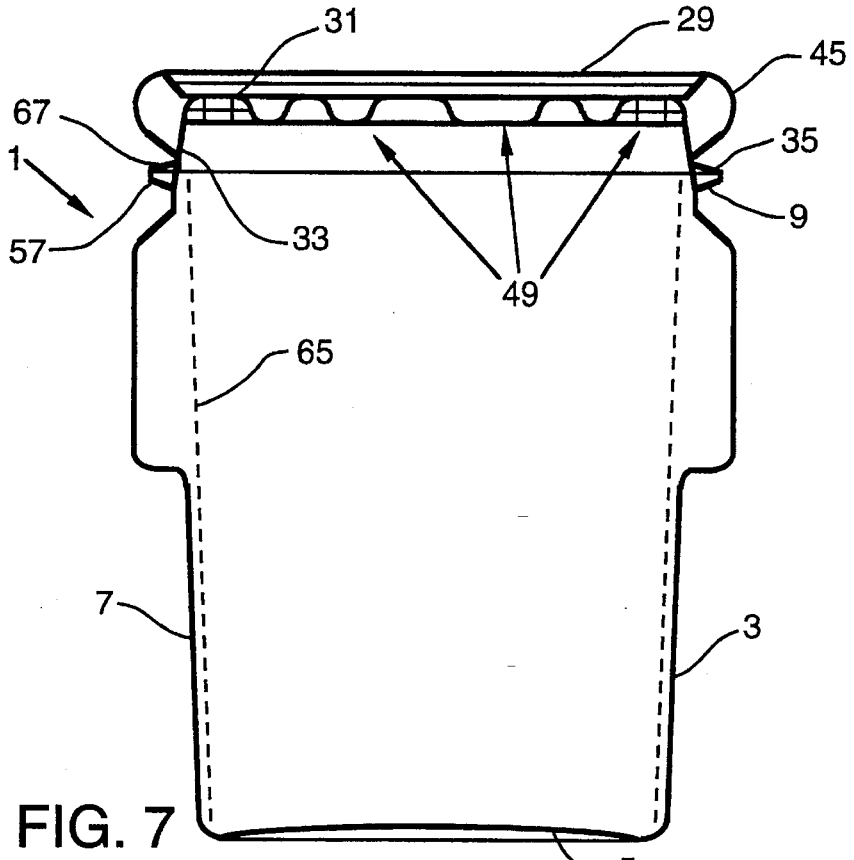
FIG. 7 is a vertical cross-sectional view of the assembled salvage drum shown in FIG. 1.
Figure 8:
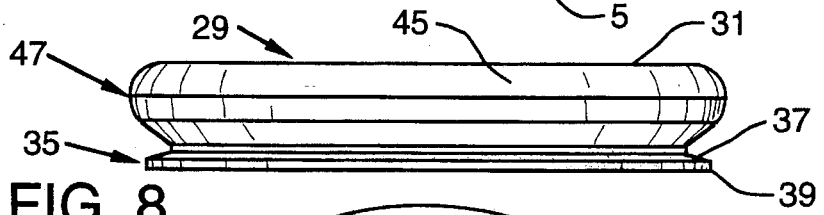
FIG. 8 is a side elevational view of the circular lid shown in FIG. 3.
Figure 9:
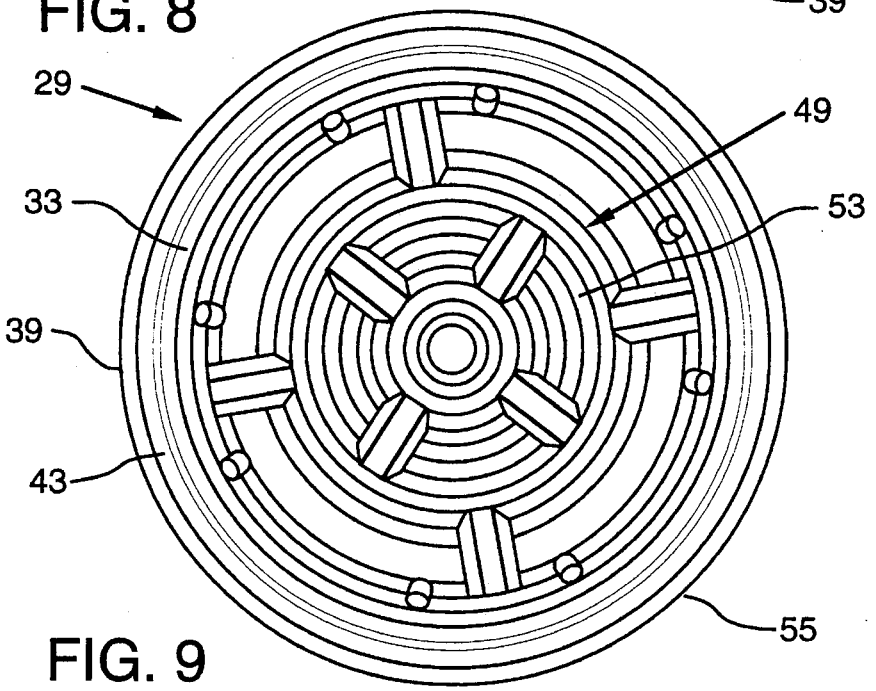
FIG. 9 is a bottom plan view of the circular lid shown in FIG. 3.
Figure 10:
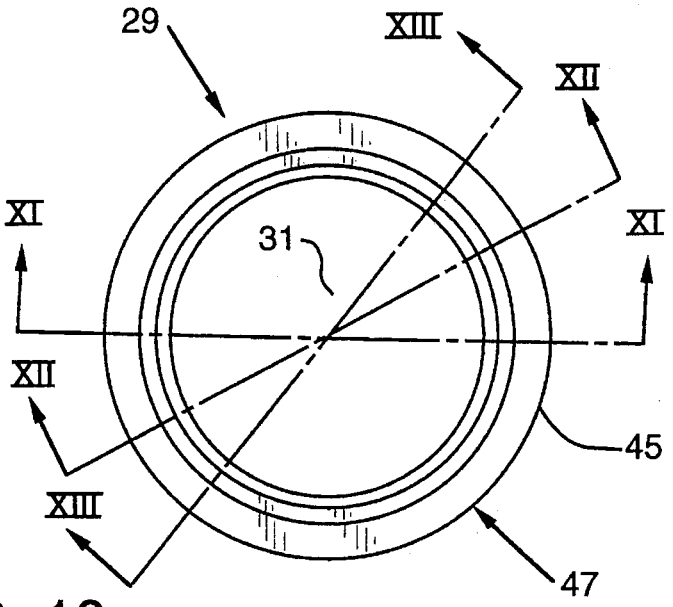
FIG. 10 is a top plan view of the circular lid shown in FIG. 3.
Figure 11:
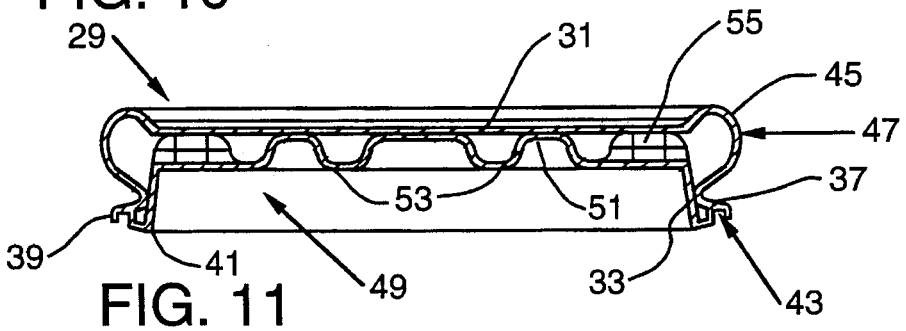
FIG. 11 is a cross-sectional view of the circular lid taken along lines XI—XI of FIG. 10.
Figure 12:
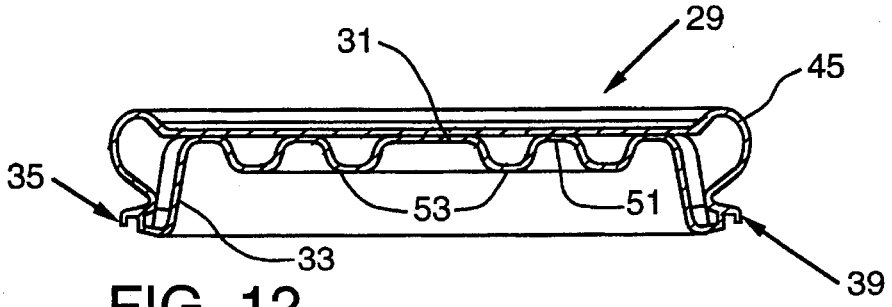
FIG. 12 is a cross sectional view of the circular lid taken along lines XII—XII of FIG. 10.
Figure 13:
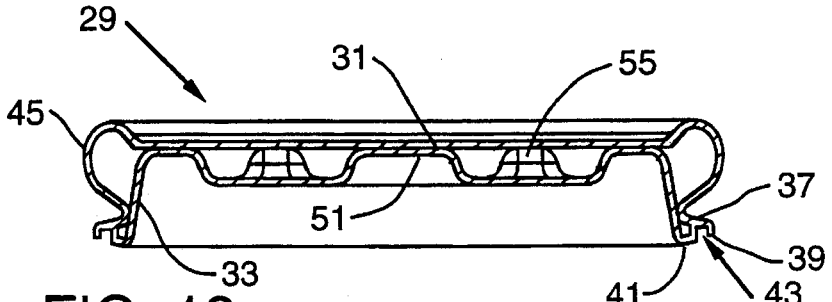
FIG. 13 is a cross-sectional view of the circular lid taken along lines XIII—XIII of FIG. 10.

In use, a drum 65, such as an industrial drum, shown in dashed lines in FIG. 7, is placed into the container body 3, and a clamping device 57, such a V-shaped clamp, is provided which may have been previously placed over the body lip 13 and rested on the upper walls 19 of the vertical ribs 17. A circular gasket 67 is preferably placed on the lid lip 35, within the gasket receiving channel 43, and may be adhesively secured in the channel 43. The circular lid 29 is then placed on the container body 3 with the gasket 67 contained with the confines of the channel 43 formed by the downwardly extending retention flange 39 of the radially outwardly extending lid lip 35, and contacting the upwardly extending flange 13 of body lip 9 (FIG. 15) to provide a seal. The V-shaped clamp 57 is then opened, if necessary, and raised a sufficient amount to allow the clamp to be placed over the lid lip 35 and body lip 9 and the clamp 57 closed and locked in place by locking means 63, so as to secure the circular lid 29 to the body portion 3 and compress the gasket 67 to seal the contents of the salvage drum 1 therein.

Figure 15:
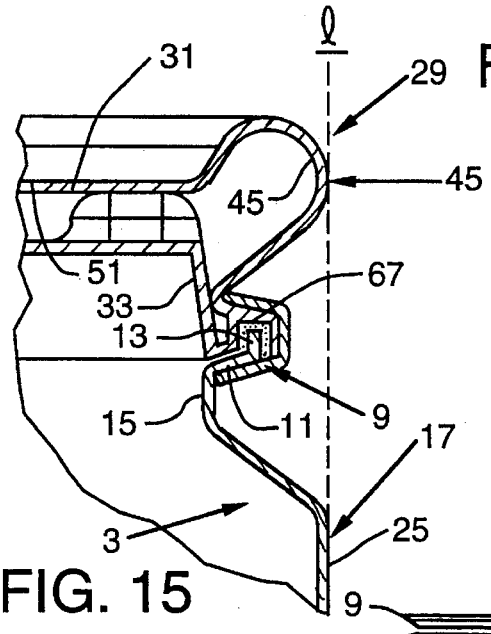
FIG. 15 is a vertical cross-sectional view showing the seal formed between the circular lid and container body by the clamping device.

When the salvage drum 1 is sealed, the clamp 57 will be protected from impact with any wall area or ground surface. As best shown in FIG. 15, with the clamp 57 situated radially inwardly from the upper outer surface 25 of the vertical rib 17 on the side wall 7 of the container body 3, and also situated radially inwardly from the outermost surface 47 of the outwardly extending protective shoulder 45 of the circular lid 29, as illustrated by the dashed line l in FIG. 15, the clamp will be protected from any impact with a wall surface or ground surface regardless of the tipping or dropping of the salvage drum 1. The location of the clamp at the lid lip 35 which is spaced from the top wall 31 by downwardly depending skirt 33, provides a seal between the lid lip 35 and body lip 9 below the top wall 31 that will, when clamped, provide a seal which will withstand an internal pressure of 3 pounds per square inch or more without bulging of the lid breaking such a seal.

Figure 16:
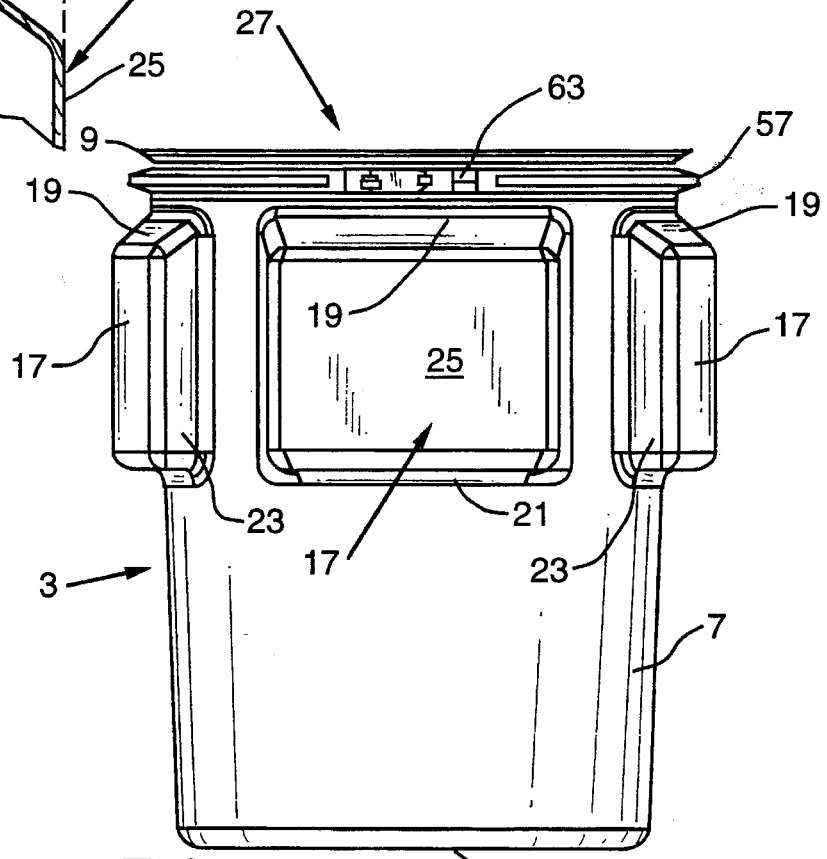
FIG. 16 is a side view of the container body of FIG. 2 with the clamping device of FIG. 14 held therein during shipment, with the clamping device resting on the vertical ribs on the container body.

An advantage of the construction of the container body 3 of the present invention, where the vertical, non-tapered section 15 is provided on the side wall 7 and the outwardly extending ribs 17 are positioned adjacent the body lip 9, is illustrated in FIG. 16. As shown in that figure, the clamp 57 may be passed over the body lip 9 of the container body 3 and rested on the upper wall 19 of the outwardly extending ribs 17 for holding during shipping and storage. The clamp 57 may be closed to tightly hold the same to the vertical, non-tapered section 15. When used for clamping the circular lid to the container body, the clamp 57 need only be opened, if necessary, and raised to the proper position and secured in place over the lid lip 35 and the body lip 9. With holding of the clamp 57 about the vertical, non-tapered section 15 of side wall 7 of the container body 3 on the container body, while resting on the vertical, outwardly extending ribs 17, the user of the salvage drum 1 need not be concerned with loss or damage of the clamp 57 before use in clamping the circular lid 29 to the container body 3. Also, when clamp 57 is tightened about the vertical, non-tapered section 15 of the side wall 17 of the container body 3 the clamp 57 will not be separated from the container body 3 even if the container body 3 turned upside down since, in such a position, the clamp 57 will rest on the upwardly sloped lower surface 11 of the container body lip 9.

The container body 3 and circular lid 29 of the present salvage drum 1 are preferably formed of polyethylene and are preferably blow molded to the shape desired. Other plastic materials may, of course, be used. The clamp 57 is preferably formed of metal, although the clamp 57 may also be formed of a plastic material which has sufficient strength to retain the container body 3 and circular lid 29 secure while compressing the gasket 67 therebetween to seal the assembly.

What is claimed is:

1. A salvage drum comprising:

a container body having a bottom wall and an upwardly extending side wall terminating to form a circular open top, with a radially outwardly extending body lip on said side wall about said open top, the side wall having a plurality of spaced outwardly extending vertical ribs spaced from and adjacent to said outwardly extending body lip;

a circular lid having a radially outwardly extending lip about the periphery thereof adapted to mate with said body lip, said circular lid having an outwardly extending protective shoulder thereabout, said protective shoulder having a radially outermost surface;

means for clamping said body lip and said lid lip together to seal the container, said means for clamping situated radially inwardly from upper outer surfaces of said vertical ribs and from the radially outermost surface of said protective shoulder.

2. A salvage drum as defined in claim 1 wherein the side wall of said container body tapers outwardly from said bottom wall towards said circular open top and wherein a vertical non-tapered section is provided between said ribs and said lip.

3. A salvage drum as defined in claim 1 wherein a sealing gasket is disposed between said body lip and said lid lip.

4. A salvage drum as defined in claim 1 wherein said means for clamping is a clamp, said clamp is of a V-shape and said body lip and lid lip are positioned in a groove of said V-shaped clamp.

5. A salvage drum as defined in claim 4 wherein said clamp is positioned about the container body and rests on said vertical ribs prior to clamping said body lip and lip lid together.

6. A salvage drum as defined in claim 1 wherein said container body and said circular lid are of blow molded polyethylene.

7. A salvage drum as defined in claim 1 wherein said lid lip has a downwardly sloped upper surface and a downwardly extending retention flange and said body lip has an upwardly sloped lower surface and an upwardly extending retention flange, which flanges mate together when said lid is secured on said body.

8. A salvage drum as defined in claim 7 wherein said circular lid has a downwardly depending skirt, and a gasket receiving channel is formed between said skirt and said downwardly extension retention flange.

9. A salvage drum as defined in claim wherein a gasket is secured in said gasket receiving channel which contacts the upwardly extending retention flange of said body lip to form a seal therebetween.

10. A plastic salvage drum comprising:

a container body having a bottom wall and an upwardly extending side wall terminating to form a circular open top, with a radially outwardly extending body lip, terminating as an upwardly extending retention flange, on said side wall about said open top, the side wall having a plurality of spaced outwardly extending vertical ribs spaced from and adjacent to said outwardly extending body lip;

a circular lid having a radially outwardly extending lip about the periphery thereof terminating as a downwardly extending retention flange, said circular lid having an outwardly extending protective shoulder thereabout, said protective shoulder having a radially outermost surface;

a gasket disposed between said body lip and said lid lip retained by said upwardly extending retention flange on said body and said downwardly extending retention flange on said lid; and means for clamping said body lip and said lid lip together to compress said gasket and seal the container, said means for clamping situated radially inwardly from upper outer surfaces of said vertical ribs and from the radially outermost surface of said protective shoulder.

11. A salvage drum as defined in claim 10 wherein the side wall of said container body tapers outwardly from said bottom wall towards said circular open top and wherein a vertical non-tapered section is provided between said ribs and said lip.

12. A salvage drum as defined in claim 10 wherein said means for clamping is a clamp, said clamp is of a V-shape, said body lip and said lid lip are positioned in a groove of said V-shaped clamp, and said clamp is positioned about the container body and rests on said vertical ribs prior to clamping said body lip and lid lip together to compress said gasket.

13. A salvage drum as defined in claim 10 wherein said container body and said circular lid are of polyethylene and said means for clamping is a V-shaped clamp formed of metal.

14. A salvage drum as defined in claim 10 wherein said circular lid has a downwardly depending skirt, and a gasket receiving channel is formed between said skirt and said downwardly extension retention flange.

15. A salvage drum as defined in claim 14 wherein said gasket is secured in said gasket receiving channel which contacts the upwardly extending retention flange of said body lip to form a seal therebetween.

* * * * *